United States Patent [19]

Karvonen

[11] Patent Number: 4,468,877

[45] Date of Patent: Sep. 4, 1984

[54] SIDE HAMMER PERCUSSION LOCK

[76] Inventor: Gary E. Karvonen, 335 S. 11th St., St. Helens, Oreg. 97051

[21] Appl. No.: 457,657

[22] Filed: Jan. 13, 1983

[51] Int. Cl.[3] ..... F41C 17/00

[52] U.S. Cl. ..... 42/70 F; 42/51

[58] Field of Search ..... 42/51, 69 R, 70 R, 70 F

[56] References Cited

U.S. PATENT DOCUMENTS

| | | | |
|---|---|---|---|
| 20,757 | 6/1858 | Brey | 42/69 R |
| 46,100 | 1/1865 | Gibbon | 42/70 F |
| 982,152 | 1/1911 | Marble | 42/42 B |
| 4,065,867 | 1/1978 | Storey | 42/51 |

*Primary Examiner*—Charles T. Jordan
*Assistant Examiner*—Ted L. Parr
*Attorney, Agent, or Firm*—Chernoff, Vilhauer, McClung, Birdwell & Stenzel

[57] ABSTRACT

A hammer assembly for a side hammer percussion lock is comprised of a hammer which is displaceable relative to the firearm from its normal operative position to a safety position where it cannot be brought into contact with a percussion cap placed on the firearm. In one embodiment of the invention the hammer is displaced by rotating it about an axis which is perpendicular to the axis about which the hammer is rotated between its cocked and firing positions. In another embodiment of the invention the hammer is displaced to its safety position by being slidably translated relative to the firearm. In the rotating embodiment, detents are provided for fixing the hammer against inadvertent movement from its desired position. In the sliding embodiment a lock is provided to prevent movement of the hammer from either its normal or safety position without first releasing the lock. A cam is provided in both embodiments to lift the hammer slightly off of the percussion cap when it is moved out of its normal position.

12 Claims, 13 Drawing Figures

FIG. 1
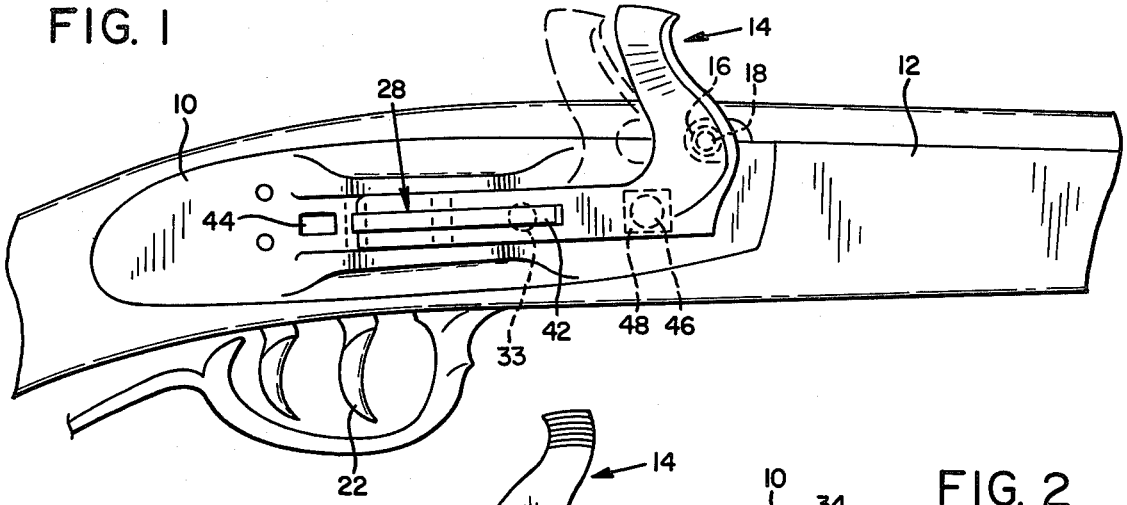
FIG. 2
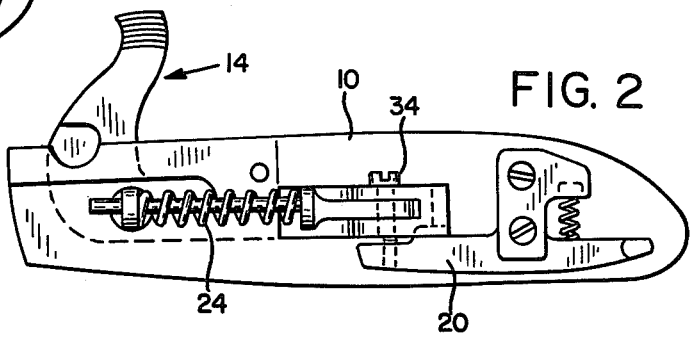
FIG. 3
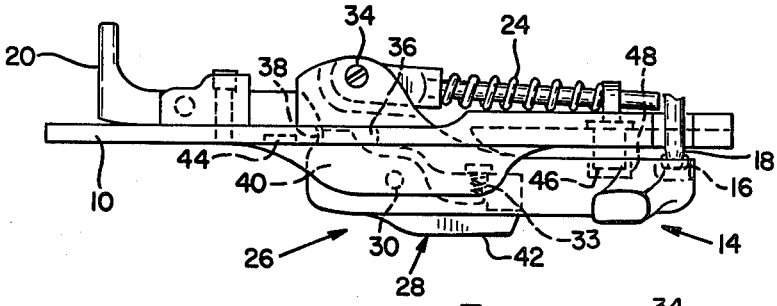
FIG. 4
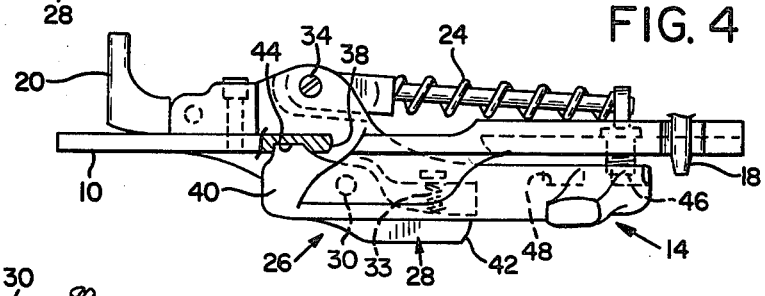
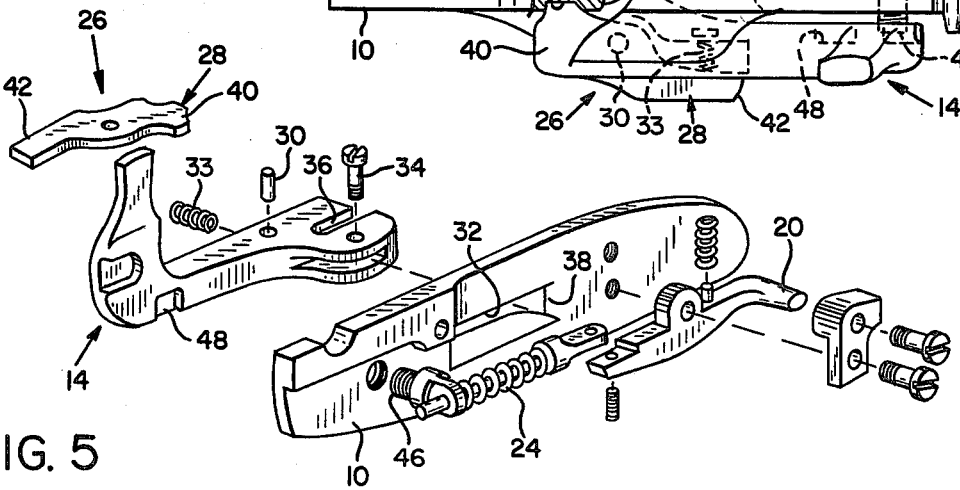
FIG. 5

FIG. 6
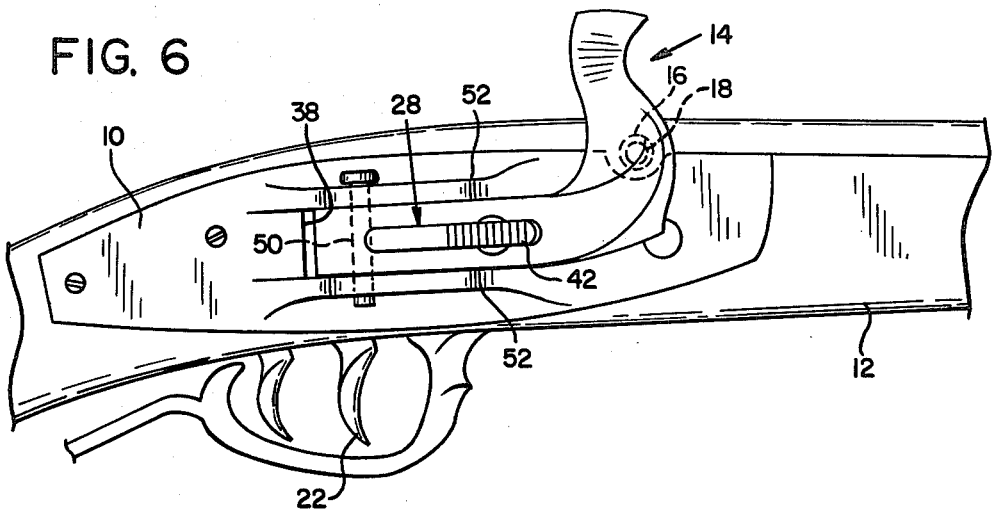
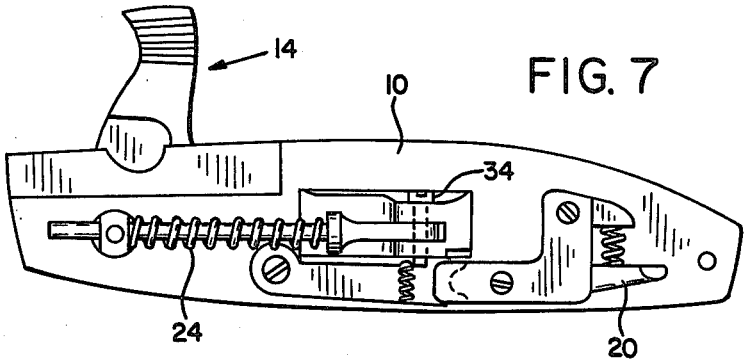
FIG. 7
FIG. 8
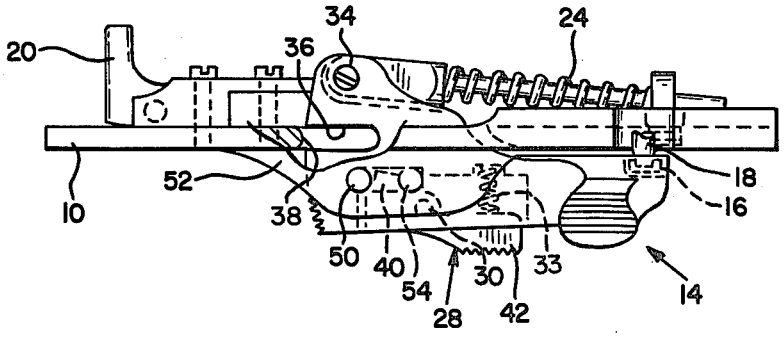
FIG. 9
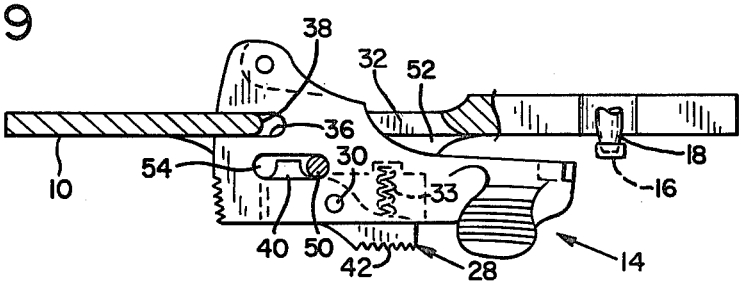

FIG. 10
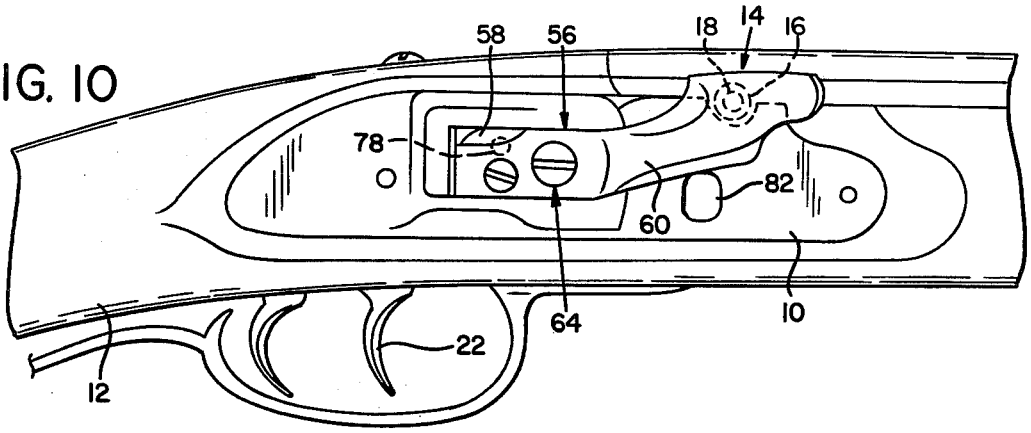
FIG. 11
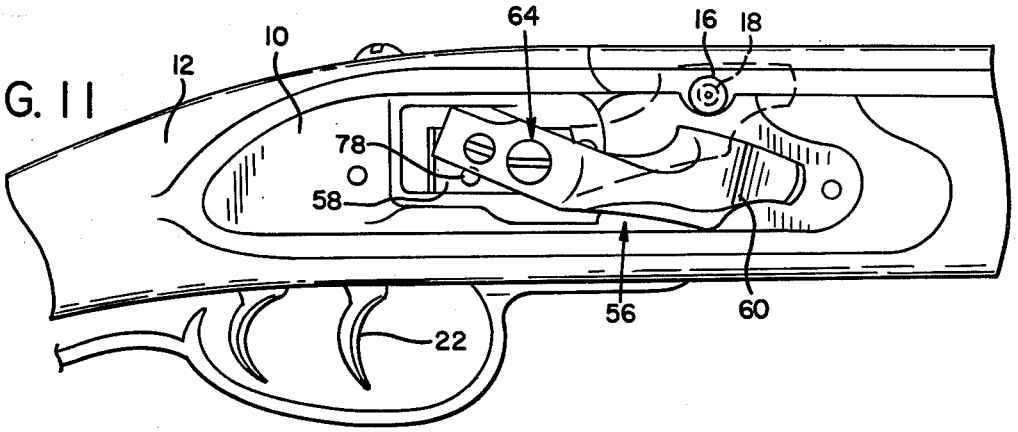
FIG. 12
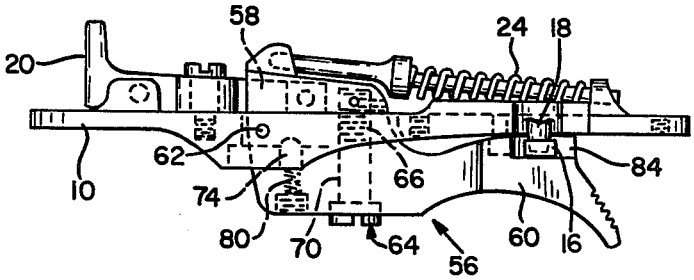
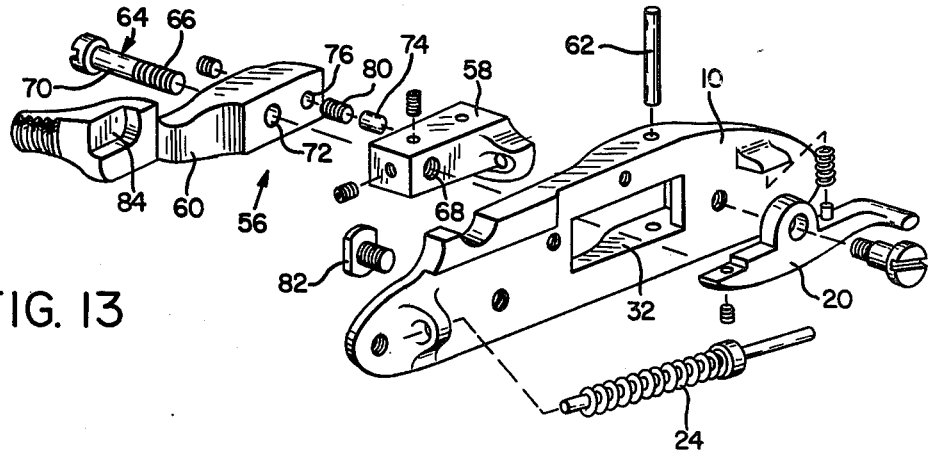
FIG. 13

SIDE HAMMER PERCUSSION LOCK

SUMMARY AND BACKGROUND OF THE INVENTION

This invention relates to side hammer percussion locks and particularly to a safety for such devices.

Percussion firearms remain popular with collectors, with both originals and reproductions available. While the side hammer percussion lock was never widely utilized, with the present invention it can be made to have a degree of safety which was heretofore not available with percussion firearms. In any percussion firearm a certain degree of danger exists whenever it is capped. In order to cap the nipple the hammer must either be placed in its cocked position, or in a half cocked position if such is available, or else the hammer must be pulled away from the nipple while the cap is being installed. If the firearm is placed in its fully cocked position is is susceptible to accidental discharge either by inadvertent pulling of the trigger or by the hammer accidently being dislodged. While a half cocked position decreases this danger, there is still a possibility that the cap will explode if the hammer is released, and if the hammer is forcibly released, such as by dropping the firearm, inadvertent firing becomes quite likely. Even when the cap is installed by pulling the hammer slightly away from the nipple and then resting it back on the cap, it is possible to inadvertently discharge the firearm by dropping it in a way in which the hammer is forced into the cap or by bumping the hammer in a manner to cause the same results.

What is needed therefore is a safety position for the hammer of a percussion firearm, where the nipple is exposed for capping and the hammer cannot thereafter strike or be forced against the cap until the safety is released.

The present invention overcomes the foregoing limitations and shortcomings of prior art percussion locks by providing means for displacing the hammer from its normal position to a safety position where it cannot be brought into contact with the percussion cap.

In a first embodiment of the invention the hammer fits within an opening in the lock plate which mounts the hammer assembly to the firearm. A slot located in the hammer co-planar with the opening allows the hammer to be slidably transmitted between its normal and safety positions. A hammer latch, which is rotatably mounted on the hammer is normally biased to a locking position by means of a spring. When the hammer is in its normal position a tang on the hammer latch co-acts with a bearing surface, defined by the rear of the opening in the lock plate, to provide the pivot point about which the hammer rotates between its cocked and firing positions. To translate the hammer to its safety position, the hammer latch is released, so that the tang is removed from the bearing surface, and the hammer is slid rearwardly until the front of the slot in the hammer co-acts with the bearing surface. When the hammer is in its safety position the hammer latch tang fits into a lock-engaging cavity in the lock plate and thus locks the hammer in this position.

In a similar embodiment the hammer does not rotate about the bearing surface at the rear of the opening in the lock plate but instead rotates about a pin which extends between flanges that extend outwardly from the lock plate. Thus the pivot point is spaced further outwardly from the point at which the hammer is attached to the main spring which pulls it to its firing position, thereby increasing the striking force of the hammer.

In a third embodiment of the invention the hammer is not displaced to its safety position by being translated but instead is rotated about an axis which is perpendicular to the axis about which the hammer moves between its cocked and firing positions.

In this embodiment the hammer is divided into an inner portion which is pivotally joined to the lock plate in a manner to allow the hammer to move between its cocked and firing positions, and an outer portion which is pivotally mounted to the inner portion. Thus the hammer is moved between its normal and safety positions by rotating the outer portion relative to the inner portion. In this embodiment rather than providing a lock, detents are provided between the two portions of the hammer to prevent inadvertent movement of the outer portion of the hammer between its safety and normal positions.

In all but one embodiment a cam located on the lock plate interacts with the hammer to lift it off of the percussion cap when the hammer is moved to its safety position in order to prevent inadvertent explosion of the cap due to its being hit by the hammer when the hammer is returned to the normal position.

Accordingly, it is a principal objective of the present invention to provide a safety for a side hammer percussion lock wherein the hammer is displaced from the percussion cap when it is in the safety position.

It is a further object of the present invention to provide such a device wherein the hammer cannot be brought into contact with the percussion cap while it is in its safety position.

It is a still further object of the present invention to provide such a device which includes means to prevent inadvertent movement of the trigger between its safety and normal positions.

It is a further object of the present invention to provide such a device where the hammer is lifted off of the percussion cap when it is moved from its normal firing position.

The foregoing and other objectives, features and advantages of the invention will be more readily understood upon consideration of the following detailed description of the invention taken in conjunction with the accompanying drawings.

BRIEF DESCRIPTION OF THE DRAWINGS

FIG. 1 is a side elevational view of a hammer assembly embodying the features of the present invention installed in a firearm.

FIG. 2 is the opposite side elevational view of the hammer assembly of FIG. 1.

FIG. 3 is a plan view of the hammer assembly with the hammer shown in its normal position.

FIG. 4 is a plan view, similar to that of FIG. 3, with the hammer shown in its safety position.

FIG. 5 is an exploded pictorial view of the hammer assembly of FIG. 1.

FIG. 6 is a side elevational view of a second embodiment of the hammer assembly of the invention shown installed in a firearm.

FIG. 7 is an opposite side elevational view of the hammer assembly of FIG. 6.

FIG. 8 is a plan view of the hammer assembly of FIG. 6 with the hammer shown in its normal position.

FIG. 9 is a plan view, similar to that of FIG. 8, with the hammer shown in its safety position.

FIG. 10 is a side elevational view of a third embodiment of the hammer assembly of the invention shown installed in a firearm.

FIG. 11 is a side elevational view of the hammer assembly of FIG. 10 shown in its safety position.

FIG. 12 is a plan view of the hammer assembly of FIG. 10.

FIG. 13 is an exploded pictorial view of the hammer assembly of FIG. 10.

DETAILED DESCRIPTION OF THE INVENTION

Referring to FIGS. 1–5 of the drawings, a preferred embodiment of the invention comprises a lock plate 10 which carries the operative parts of the hammer assembly and which attaches it to the firearm 12. The hammer 14 is movable between a firing position, FIG. 3, where it is in contact with a percussion cap 16 located on the nipple 18 of the firearm, and a cocked position where it is rotationally removed from the percussion cap. Once the hammer is manually moved to its cocked position it is held there by means of a sear 20 in the same manner as is common in the prior art. When the trigger 22 is pulled by the user it causes the sear to be disengaged from the hammer thus allowing the main spring 24 to move the hammer forcibly to its firing position and fire the firearm.

The present invention differs from prior art side hammer percussion locks in that in addition to providing pivot means for rotating the hammer between its cocked and firing positions, displacement means are also provided for moving the hammer from the normal position described above to a safety position where it cannot come into contact with the percussion cap.

Locking means 26, such as hammer latch 28, serves to lock the hammer in both its safety and normal positions to prevent unintentional or accidental movement from that position. The hammer latch 28 is rotatably mounted on the hammer by means of a pin 30 and is biased to a locking position by a spring 33, FIG. 5. The hammer slidably extends through an opening 32 in the lock plate where it is connected to the main spring 24 by means of a screw 34. Located in the hammer, co-planar with the lock plate 10, is a slot 36 which allows the hammer to slidably translate between its normal and safety positions. When the hammer is in its normal position, a tang 40 located on the hammer latch 28 fits into the slot 36 where it co-acts with the rounded bearing surface 38 formed at the rear of the opening 32 to provide the pivot about which the hammer rotates between its cocked and firing positions, FIG. 3. When the hammer is in its safety position, on the other hand, the slot 36 fits over the lock plate to prevent rotation of the hammer to its cocked position.

In addition, when the hammer is in its normal position the tang 40 engages the bearing surface 38 to prevent the hammer from being moved to its safety position. However, when the hammer latch is released by pressing the thumb pad 42 the tang 40 is lifted out of the slot 36 thereby allowing the hammer to be slid rearwardly to its safety position. At that point when the hammer lock is released the tang protrudes into a lock-engaging cavity 44 located in the lock plate, FIG. 4, to lock the hammer in its safety position. Thus the hammer cannot be returned to its normal position without again depressing the thumb pad 42.

In order to prevent the hammer from rubbing on the percussion cap 16 when it is being moved from its normal position to its safety position, or hitting the percussion cap when it is being moved back to its normal position, a cam 46 located on the side of the lock plate is arranged to lift the hammer away from the percussion cap. When the hammer is in its normal position the cam 46 fits into a recess 48 located in the hammer. Also, the slot 36 is arranged to be at a slight angle with respect to the lock plate which causes the hammer to be lifted away from the percussion cap when it is displaced to its safety position.

The aforedescribed embodiment of the invention is designed for a standard percussion firearm. A musket, on the other hand, has a larger percussion cap and more hitting power is required to explode it. Thus another embodiment of the invention, designed for a musket, is illustrated in FIGS. 6–9.

In this embodiment rather than making the rear edge of the opening in the lock plate the bearing surface about which the hammer rotates between its cocked and firing positions, a pin 50 serves this purpose. The pin extends between flanges 52 which extend outwardly from the lock plate 10. Thus the distance between the screw 34 which connects the hammer to the main spring and the pivot point is greater in this embodiment than in the previously described embodiment giving the main spring a greater lever arm to act through for increased striking power. To accommodate the pin an additional slot 54 is provided in the hammer. The slot 36 is co-planar with the lock plate remains in this embodiment to permit the hammer to slide between its normal and safety positions.

In this embodiment a lock-engaging cavity is not required since the tang 40 fits into the slot 54 behind the pin to lock the hammer in its safety position, FIG. 9. Also, in this embodiment there is no cam. Instead, the angle between the slot 36 and the lock plate 10 is greater than in the previous embodiment and thus provides sufficient lifting by itself.

The remainder of the hammer assembly is the same in this embodiment as it is in the previous embodiment.

In a third embodiment of the invention, shown in FIGS. 10–13, the hammer is rotated about a second axis which is perpendicular to the cocking axis, to displace it to the safety position rather than its being translated as in the two previously described embodiments. In this embodiment the hammer 56 is divided into an inner portion 58 and an outer portion 60. The inner portion fits into the opening 32 in the lock plate where it is pivotally mounted by means of a pin 62. Thus the pin 62 acts as the first axis of rotation about which the hammer rotates between its cocked and firing positions.

The inner portion 58 of the hammer is attached to the outer portion by a bolt 64. The bolt 64 has a threaded extremity 66 which fits into a threaded opening 68 in the inner portion and a non-threaded bearing portion 70 which fits rotatably through a bore 72 located in the outer portion. Thus the bolt 64 acts as a bearing about which the outer portion 60 of the hammer rotates relative to the inner portion between the normal position, FIG. 10 and the safety position, FIG. 11.

A lock pin 74 which slidably fits in a passageway 76 formed in the outer portion of the hammer is urged into one of two spherical cavities 78 located in the inner portion of the hammer by means of a spring 80. The locking pin acts as a detent to retain the hammer in either its normal or safety position. As in the first embodiment, a cam 82 interacts with the hammer to lift it off of the percussion cap when the hammer is being moved to its safety position. When the hammer is in its normal position, the cam 82 lies below the hammer and does not interfere with it, FIG. 10.

The terms and expressions which have been employed in the foregoing description are used therein as terms of description and not of limitation, and there is no intention in the use of such terms and expressions of excluding equivalents of the features shown and described or portions thereof, it being recognized that the scope of the invention is defined and limited only by the claims which follow.

I claim:

1. A hammer assembly for a side hammer percussion lock on a firearm, comprising:

(a) a hammer;

(b) first pivot means for rotating said hammer about a first axis between a firing position where it is in contact with a percussion cap located on the firearm, and a cocked position where it is rotationally removed from said percussion cap; and (c) displacement means for displacing said hammer from its firing position to a safety position in which it cannot be rotated about said first axis.

2. The hammer assembly of claim 1 including detent means for indexing said hammer in both its firing and safety positions.

3. The hammer assembly of claim 1 including locking means for preventing movement of said hammer between its firing and safety positions without first initiating the release thereof.

4. The hammer assembly of claim 3 wherein said displacement means comprises sliding means for translating said hammer linearly with respect to said firearm.

5. The hammer assembly of claim 4 wherein said sliding means comprises a slot located in said hammer, said first pivot means includes a bearing surface which passes through said slot, and said locking means is positionable in said slot when said hammer is in its firing position in a manner to co-act with said bearing surface to provide said first pivot means.

6. The hammer assembly of claim 5 wherein when said locking means also co-acts with said bearing surface to prevent translation of said hammer to its safety position.

7. The hammer assembly of claim 5 wherein said slot is arranged such that when said hammer is in its safety position said slot co-acts with the rest of said hammer assembly to prevent rotation of said hammer to its cocked position.

8. The hammer assembly of claim 7 wherein said locking means is attached to said hammer, including lock-engaging means located on said hammer assembly arranged to engage said locking means when said hammer is in its safety position to prevent translation of said hammer to its firing position.

9. The hammer assembly of claim 7 wherein when said hammer is in its safety position said locking means passes through said slot and co-acts with said bearing surface to prevent translation of said hammer to its firing position.

10. The hammer assembly of claim 1 including separation means for lifting said hammer out of contact with said percussion cap when it is displaced from said firing position.

11. The hammer assembly of claim 1 wherein said displacement means comprises second pivot means for rotating said hammer about a second axis which is perpendicular to said first axis.

12. The hammer assembly of claim 11 wherein said hammer is divided into an inner portion which is rotatably mounted to the rest of the hammer assembly through said first axis and an outer portion which is rotatably mounted to said inner portion through said second axis.

* * * * *

UNITED STATES PATENT AND TRADEMARK OFFICE

CERTIFICATE OF CORRECTION

PATENT NO. : 4,468,877

DATED : September 4, 1984

INVENTOR(S) : Gary E. Karvonen

It is certified that error appears in the above-identified patent and that said Letters Patent is hereby corrected as shown below:

Col. 1, line 47 Change "transmitted" to --translated--.

Col. 4, line 63, Change "lock" to --locking--.

Signed and Sealed this

*Twenty-sixth* Day of *November 1985*

[SEAL]

*Attest:*

DONALD J. QUIGG

*Attesting Officer*

*Commissioner of Patents and Trademarks*